US012171357B2

(12) United States Patent
Nawaratne

(10) Patent No.: US 12,171,357 B2
(45) Date of Patent: Dec. 24, 2024

(54) SMART CHRISTMAS TREE

(71) Applicant: Kosala Nawaratne, Gampaha (LK)

(72) Inventor: Kosala Nawaratne, Gampaha (LK)

( * ) Notice: Subject to any disclaimer, the term of this patent is extended or adjusted under 35 U.S.C. 154(b) by 300 days.

(21) Appl. No.: 17/537,561

(22) Filed: Nov. 30, 2021

(65) Prior Publication Data

US 2022/0183493 A1 Jun. 16, 2022

Related U.S. Application Data

(60) Provisional application No. 63/124,072, filed on Dec. 11, 2020.

(51) Int. Cl.
*A47G 33/08* (2006.01)
*A47G 33/06* (2006.01)

(52) U.S. Cl.
CPC ..... *A47G 33/0809* (2013.01); *A47G 33/06* (2013.01); *A47G 33/0818* (2013.01)

(58) Field of Classification Search
CPC . A47G 33/06; A47G 33/0809; A47G 33/0818
See application file for complete search history.

(56) References Cited

U.S. PATENT DOCUMENTS 2,498,467 A * 2/1950 Webber ..... A47G 33/0809 428/3
5,455,750 A * 10/1995 Davis ..... F21S 4/10 428/18
6,152,800 A * 11/2000 Higuchi ..... A47G 33/0809 238/10 F
2011/0032225 A1* 2/2011 Dang ..... H05B 47/155 345/204
2011/0284483 A1* 11/2011 Joscher ..... A47F 5/0838 211/1.52
2016/0053939 A1* 2/2016 Coleman ..... A47G 33/0809 248/610

* cited by examiner

*Primary Examiner* — Charles A Fox
*Assistant Examiner* — Gregory T Prather
(74) *Attorney, Agent, or Firm* — Jose Cherson Weissbrot

(57) ABSTRACT

A decorative artificial tree comprising: a base stand; a plurality of connectable trunk sections; a plurality of leaved branch sections connectable to the trunk sections; a decorative object; a microcontroller; and, a motorised rotary mechanism comprising a support bar connected thereto, at one end of the support bar there is a counterweight, at the opposing end of the support bar the decorative object is attached; such that, in use when the motorised rotary mechanism is activated, the decorative object travels around the decorative tree.

8 Claims, 5 Drawing Sheets

SMART CHRISTMAS TREE

The present invention relates to decorative trees. Particularly it relates to artificial decorative trees. More particularly it relates to artificial Christmas trees. Even more particularly it relates to artificial Christmas trees with integral automated decoration.

BACKGROUND OF THE INVENTION

Throughout the world millions of families, private and state sectors are used to celebrate Christmas or an analogue every year around December. The staple and most common decoration for this festive period is the Christmas tree. So, it is a very common practice to buy a natural or fake Christmas tree before/at the start of the festive period.

Decoration of the tree has become a big part of the tradition and also somewhat a status symbol. Therefore, people/originations are always wanting to find new and/or impressive ways to decorate their tree and give it a memorable "wow factor" to those who see it.

One known, but always impressive decoration is the train/sleigh etc going around the tree on a track, the track either positioned on the floor around the trunk of the tree or around the body of the tree supported by the wider branches of the lower half of the tree. Although widely recognisable, these sorts of decorations are not particularly common due to expense and instability when installed (especially those mounted around the body of the tree), meaning that for most, having such a delightful feature is not worth the cost/effort/risk. And to others the often-large track the train/sleigh rides on can be considered unsightly.

It is an object of the present invention to provide a smart artificial Christmas tree which differs from an ordinary tree because it integrally comprises a moving sleigh with a reindeer and the Santa clause while a festive tune is played. The movement of sleigh such that it turns around the tree while it climbing up and down a little, without the presence of an externally visible track. The sleigh is arranged such that no track is visible and it appears a running/flying reindeer pulls the sleigh while it is ridden by Santa clause. The reindeer may be motorized and can move its' legs to imitate a running reindeer. In addition, the device may have a set of colour lights that run according to the pre-set illuminating patterns. The switching panel of the device is designed so that you can disable or enable any feature as your wish. In addition to the enable switches, PIR motion sensors may be attached to the device feet to activate the motion of the sleigh and the play of jingle bells automatically.

STATEMENT OF INVENTION

According to a first aspect of the invention there is provided a decorative artificial tree comprising: a base stand; a plurality of connectable trunk sections; a plurality of leaved branch sections connectable to the trunk sections as known in the art. there is also a decorative object; a microcontroller; and, a motorised rotary mechanism comprising a support bar connected thereto, at one end of the support bar there is a counterweight, at the opposing end of the support bar the decorative object is attached. Such that, in use when the motorised rotary mechanism is activated, the decorative object travels around the decorative tree with a reciprocal vertical movement applied by the rotary mechanism.

An embodiment of the first aspect further comprising at least one motion sensor, such that in use, when the motion sensor is triggered it sends a signal to the microcontroller which in turn activates the motorised rotary mechanism.

An embodiment of the first aspect wherein the rotary mechanism further comprises: a cam and a cam follower. The cam follower being connected to the support bar; such that, in use, when the rotary mechanism is activated, the support bar follows the cam surface and the decorative object travels around the decorative tree in an undulating path.

An embodiment of the first aspect further comprising a speaker connected to the micro controller, such that, when the rotary mechanism is active the speaker plays a musical tune.

An embodiment of the first aspect wherein the plurality of leaved branches come in a plurality of pre-defined sizes and attachment locations, such that in use the leaved branches hide the motorised rotary mechanism and support bar so only the decorative object is visible.

An embodiment of the first aspect, wherein the decorative object comprises lights. The lights may be controlled by the micro controller, to be activated when the motorised rotary mechanism is activated.

An embodiment of the first aspect, wherein the artificial decorative tree is an artificial Christmas tree.

An embodiment of the first aspect, wherein the decorative object is Santa and his sleigh being pulled by reindeer.

BRIEF DESCRIPTION OF THE DRAWINGS

The invention will be described in more detail, by way of example, with reference to the following drawings.

DETAILED DESCRIPTION

Figure 1A:
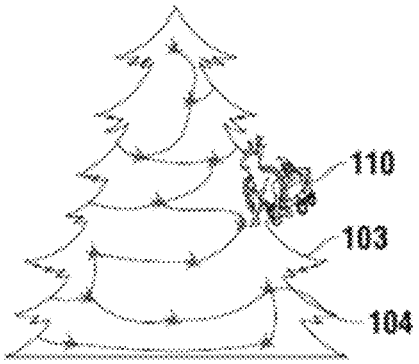
FIG. 1A-C depicts an embodiment of the invention.
Figure 1B:
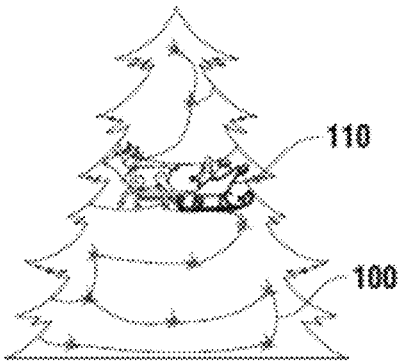
Figure 1C:
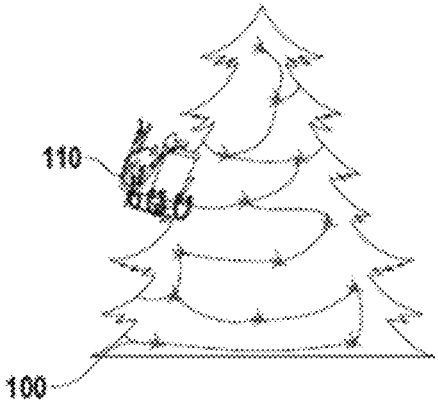
Figure 2A:
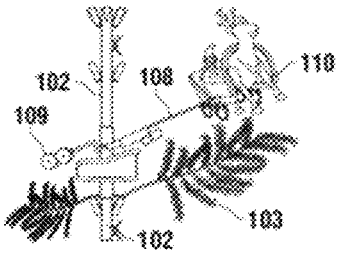
FIG. 2A-D depicts an embodiment of the invention with the branches removed.
Figure 2B:
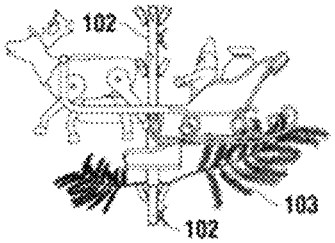
Figure 2C:
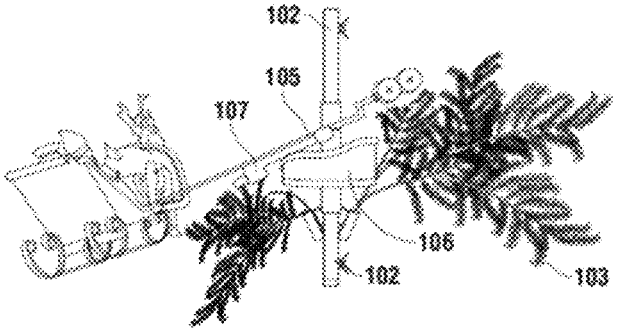
Figure 2D:
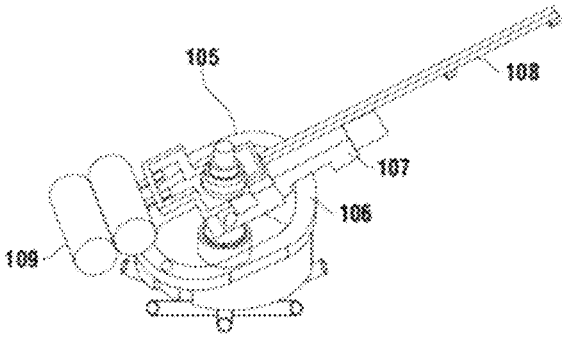

FIG. 1A-C shows a view of an artificial Christmas tree 100 according to the present invention and integral automated decoration 110 (in this case Santa's sleigh, but not limited to this embodiment). FIG. 1A is at a time immediately after the device has been activated and the automated sleigh 110 has started its journey around the Christmas tree and the sleigh 110 is at position one.

FIG. 1B shows the sleigh further along its journey around tree 100 and in position two, which, in this embodiment, is approximately a quarter rotation around the circumference of the tree 100, and at a different vertical (assuming the tree 100 is standing upright) elevation in comparison to position one.

FIG. 1C shows the sleigh 110 further along its journey around tree 100 and in position three, in this embodiment at position 3 the sleigh 100 is approximately a further quarter rotation around the circumference of the tree 100 in relation to position 2, and the sleighs 110 vertical elevation has moved to an elevation approximately the same to that of position 1.

Not shown in FIG. 1 is the sleigh 110 at position zero (or home position). In this embodiment position zero is located on the opposite side of tree 100 to that of position 2. Position zero is the location where the sleigh 110 rests when not active, typically in use, a user will position tree 100 such that position zero is facing a wall/corner of the room tree 100 is located in such that, when not activated sleigh 110 is hidden from general view.

As can be seen in FIG. 1A-C there is no track and decoration/sleigh 110 appears to be flying around tree 100.

As can be seen in FIGS. 1 and 2, the artificial tree assembly of the present invention is substantially the same as what is established in the art. The artificial tree comprises a foldable stand 101, a plurality of pieces of trunk 102, tree leaves with branches 103 and decorating lights 104.

The present invention however, additionally has a rotary mechanism 105 associated with the trunk pieces 102, the rotary mechanism 105 comprising any suitable rotary motor known in the art, a cam 106, a cam follower 107, support bar 108, and counterweight 109. Which drives the Santa on the sleigh and the running reindeer 110 around the tree 100 in an undulating path.

The sleigh 110 is activated when a person/body moves close to the tree 100. The tree 100 comprises one or more (preferably 4) motion sensors, preferably passive infrared (PIR) motion sensors to detect movement near to the tree 100. But any suitable sensor/trigger known to the skilled person could be used (for example, laser, ultrasonic, inductive proximity, capacitive proximity, or even a foot operated/touch switch) The sensors can be mounted at any suitable location on the tree 100, but in a preferred embodiment they are mounted on the stand 101. A micro controller is used to control the whole system. It registers the motion near the tree 100 by means of the one or more PIR motion sensors and depending on the user settings then activates the rotary mechanism 105 to articulate the sleigh 110.

The microcontroller, controls the whole system via a user-controlled control card. The control card consists 10 switches, the purpose of each switch on the control card are as follows:

01. ON/OFF—Power and 1st Lighting Pattern
02. Enable—Sleigh motion
03. Enable—Jingle bells tune play
04. 4-6. Enable—2nd, 3rd and 4th Lighting Pattern
05. 7-10. Disable—Each PIR motion sensor independently (4 Switches are provided to disable each PIR motion sensor so that the tree can be placed near an obstacle such as wall. Disable switches can avoid malfunction of desired sleigh movement)

Figure 3:
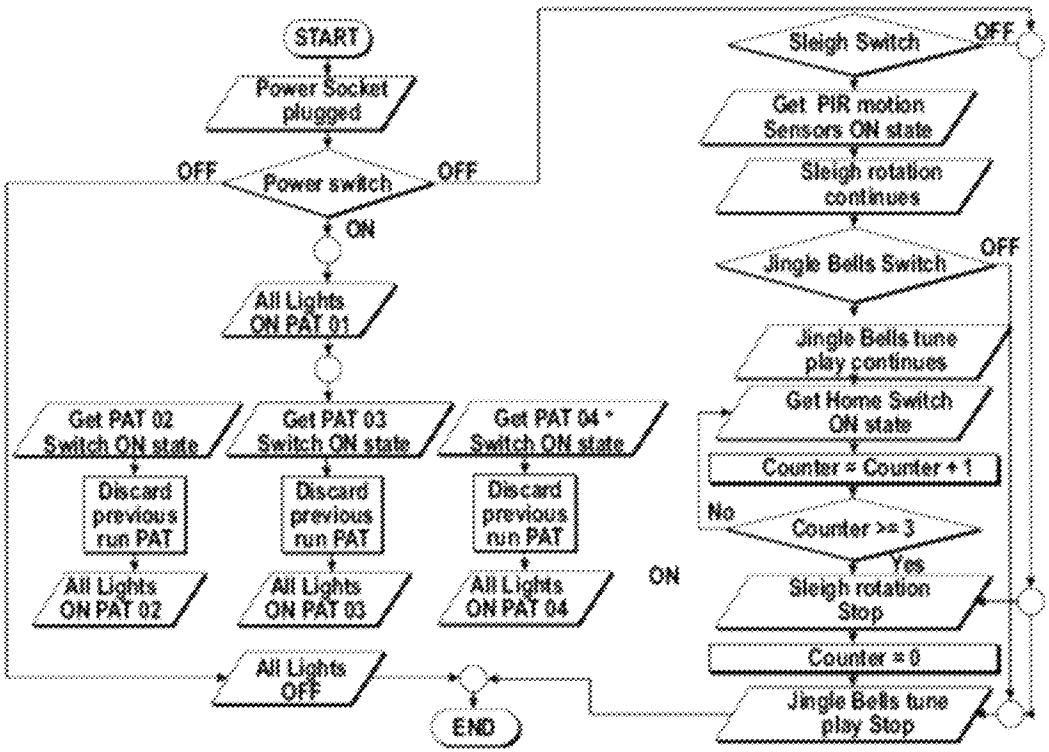
FIG. 3 depicts the control flowchart for rotation of a decorative object and lighting pattern (PAT)
Figure 4:
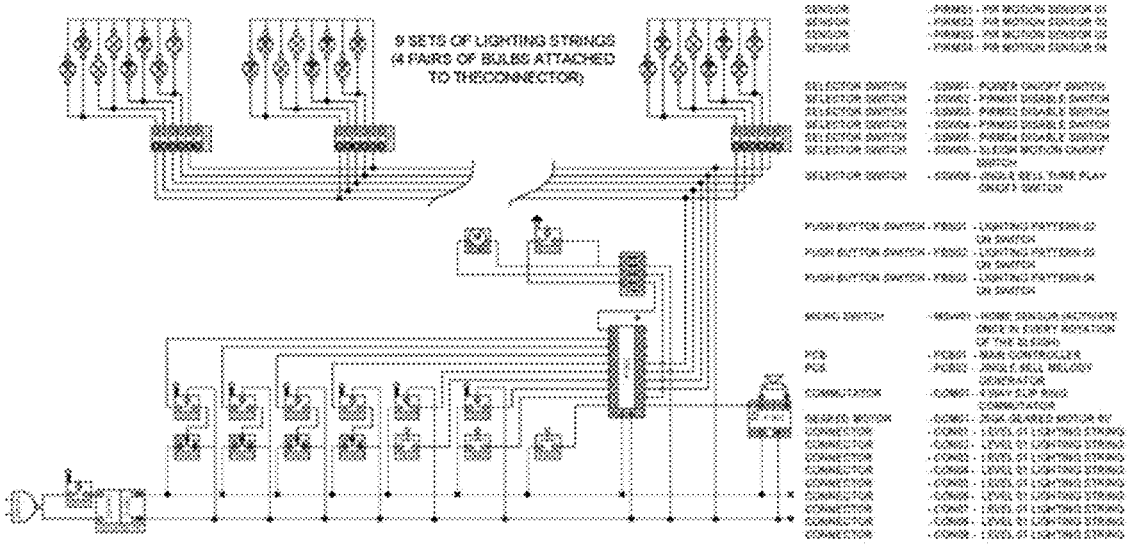
FIG. 4 shows the control wiring diagram.

To ensure the tree is safe, all the controls use 6.0 Vdc a low voltage supplied by a stepdown isolation transformer. Therefore, all the decorative lights are LEDs coloured or otherwise. A 4-way slip ring commutator is used at the rotary mechanism to keep power to drive motors of reindeer, sleigh and lights of sleigh while the complete system rotates around the tree. FIGS. 3 and 4 show preferred embodiments of the control logic and circuitry respectively.

The cam and the cam follower may have teeth so that it avoids slipping and wearing on the cam surface. To eliminate the visibility of the connecting rod 108 placed in between the sleigh 110 and the rotary cam follower 107, sleigh 110 can be designed to have a curved shape along the long (Y) axis, see FIG. 5.

The sleigh can be made by any suitable means such as 3D printing, blow moulded plastic or any other suitable method known to the skilled person.

Figure 5:
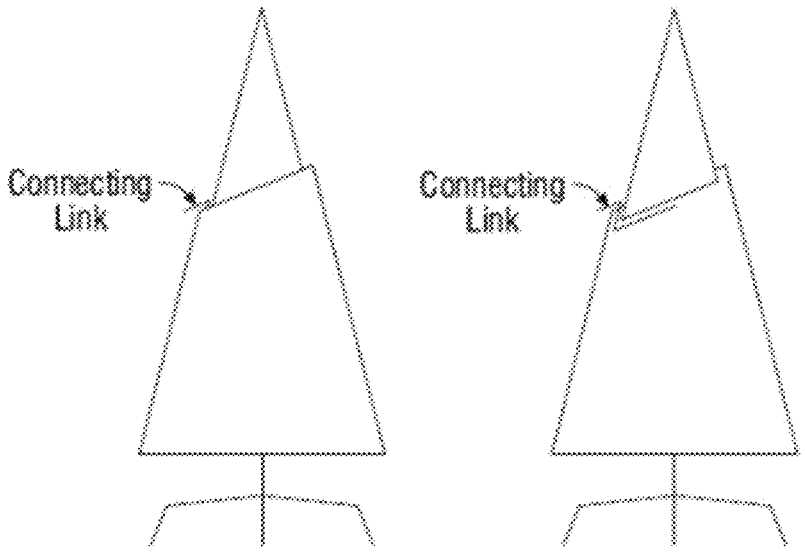
FIG. 5 is a schematic of how the rotary mechanism can be hidden from view.

Tree branches of different lengths must be attached to the adjacent levels of the rotary mechanism 105. This is because the sleigh climbs up and down when it rotates around the tree and therefore suitable branches in different sizes around the rotary mechanism are needed to hide the connecting rod 108. The higher side of the cam profile needs longer tree branches, whereas the lower side of the cam profile require smaller branches. The tree branches of adjacent levels of the rotary units have to be rigid (not flexible leaves) to ensure a clear path for the connecting rod to move through. In addition, the tree branches can be arranged as shown in FIG. 5 to completely hide the connection rod 108.

All the power connections from control card to motors, lights and home sensor can be arranged through bus bar plugging system. While 5-way bus bar system drive decorating lights, a 3-way bus bar system drive the sleigh motors, lights and home sensor. Bus bars have to be attached to each piece of tree trunks. Both bus bar system attached to the trunk of the tree. Each piece of trunk must have a bus bar socket at one end and a bus bar plug at the other end. When the trunk pieces are connected in series the bus bar systems are also connected in series. This will eliminate the complex power connection of all the sub item of the tree such as lights, motors and sensors and turn this in to a plug and play device. Wire harness has to be laid inside the trunk (centre tube) of the rotary mechanism connects the upper and lower 5-way bus bar system.

Alternate rotary systems other than the one described above can be used.

The invention has been described with reference to preferred embodiments. The description is intended to enable a skilled person to make the invention, not to limit the scope of the invention. The scope of the invention is determined by the claims.

What is claimed is:

1. A decorative artificial tree comprising: a base stand; a plurality of connectable trunk sections defining a central axis; a plurality of leaved branch sections connectable to the trunk sections; a decorative object; a microcontroller; a motorised rotary mechanism comprising a support bar rotationally connected to the motorised rotary mechanism, a cam, and a cam follower connected to the support bar; and a decorative object attached at an end of the support bar; configured such that, in use: when the motorised rotary mechanism is activated via the microcontroller, the support bar rotates about the central axis following the cam surface, so that the decorative object travels around the central axis in an undulating path.

2. The decorative artificial tree according to claim 1, further comprising at least one motion sensor, such that in use, when the motion sensor is triggered the motion sensor sends a signal to the microcontroller which in turn activates the motorised rotary mechanism.

3. The decorative artificial tree according to claim 1, comprising a speaker connected to the micro controller, which plays a musical tune when the motorised rotary mechanism is active.

4. The decorative artificial tree according to claim 1, wherein the plurality of leaved branches have a plurality of pre-defined sizes and attachment locations, such that in use the leaved branches hide the motorised rotary mechanism and support bar so only the decorative object is visible.

5. The decorative artificial tree according to claim 1, wherein the decorative object comprises lights.

6. The decorative artificial tree according to claim 5, wherein the lights are activated by the microcontroller when the motorised rotary mechanism is activated.

7. The decorative artificial tree according to claim 1, wherein the artificial decorative tree is an artificial Christmas tree.

8. The decorative artificial tree according to claim 1, wherein the decorative object is Santa and his sleigh being pulled by reindeer.

* * * * *